US006871753B2

(12) United States Patent
McHutchinson

(10) Patent No.: US 6,871,753 B2
(45) Date of Patent: Mar. 29, 2005

(54) TAMPER PROOF HINGED LID CONTAINER

(75) Inventor: Roy Neil McHutchinson, South Perth (AU)

(73) Assignee: In-Vivo Systems Limited, Norfolk (GB)

( * ) Notice: Subject to any disclaimer, the term of this patent is extended or adjusted under 35 U.S.C. 154(b) by 0 days.

(21) Appl. No.: 10/333,648

(22) PCT Filed: Jul. 19, 2001

(86) PCT No.: PCT/AU01/00875

§ 371 (c)(1),
(2), (4) Date: Jun. 5, 2003

(87) PCT Pub. No.: WO02/08073

PCT Pub. Date: Jan. 31, 2002

(65) Prior Publication Data

US 2003/0189047 A1 Oct. 9, 2003

(30) Foreign Application Priority Data

Jul. 19, 2000 (AU) ..... PQ8870

(51) Int. Cl.[7] ..... B65D 41/06

(52) U.S. Cl. ..... 220/296; 220/254.6; 215/901; 215/254

(58) Field of Search ..... 220/296, 254.6, 220/254.7, 254.1, 259.1, 268, 279, 280; 215/901, 254, 257

(56) References Cited

U.S. PATENT DOCUMENTS

| | | | | | |
|---|---|---|---|---|---|
| 177,336 | A | * | 5/1876 | Jewell | 220/279 |
| 1,412,175 | A | * | 4/1922 | Gasset | 220/267 |
| 4,252,248 | A | | 2/1981 | Obrist et al. | |
| 4,474,304 | A | | 10/1984 | Jacobs | |
| 4,817,807 | A | * | 4/1989 | Hummer | 215/253 |
| 4,969,573 | A | * | 11/1990 | Dupuis et al. | 220/258.5 |
| 5,040,695 | A | | 8/1991 | Adams et al. | |
| 5,678,718 | A | * | 10/1997 | Morris et al. | 220/254.1 |
| 5,711,441 | A | | 1/1998 | Adams et al. | |
| 5,758,793 | A | | 6/1998 | Forsyth et al. | |
| 5,813,564 | A | * | 9/1998 | Luo | 220/522 |
| 6,116,441 | A | * | 9/2000 | Decelles et al. | 215/237 |

FOREIGN PATENT DOCUMENTS

| | | |
|---|---|---|
| CA | 2 095 795 | 11/1994 |
| GB | 747 325 | 4/1956 |
| GB | 869 726 | 6/1961 |
| GB | 1 263 755 | 2/1972 |
| GB | 2 297 746 | 8/1996 |
| GB | 2 319 244 | 5/1998 |
| WO | WO 79/00722 | 10/1979 |
| WO | WO 97/33803 | 9/1997 |
| WO | WO 00/34141 | 6/2000 |

* cited by examiner

*Primary Examiner*—Lien Ngo
(74) *Attorney, Agent, or Firm*—Merchant & Gould P.C.

(57) ABSTRACT

A tamper proof ABS plastic container comprising a container body within which medical or hygiene products such as capsules or tablets can be accommodated, the container body including a base section (1) and a lid section (3) of an intermediate section (7) and cover (5) with cooperating coupling means (17) to engage with the intermediate section (7); a tamper prevention means (9) interconnecting the base and lid sections of the container body, the tamper prevention means including a web section (11) located between and secured to both the base and lid sections, and a hanging pull tab (13); wherein the web section is detachable from the container, the detaching of the web section allowing separation of the base and lid sections of the container body and visual indication that the container has been opened. Also provided is a method of injection molding of the base section, web section and intermediate section as an integral unit.

8 Claims, 12 Drawing Sheets

TAMPER PROOF HINGED LID CONTAINER

The present invention is generally directed to containers for storing products, and in particular to a container having tamper prevention features. Although the present invention will be described with respect to the packaging of medical or hygiene products such as drug capsules or tablets, condoms or tampons, it is to be appreciated that the present invention is not restricted to this application and that other uses are also envisaged.

Products of the above mentioned type are commonly sold in cardboard cartons. These cartons can be covered by heat wrapped plastic sheeting to afford a limited degree of tamper prevention by preventing the opening of the carton to gain access to the contents without tearing of the plastic wrapping. The tearing of the wrapping provides a visual indication that the packaging has been opened. This type of wrapping does not however prevent a more malicious form of tampering where the products are dosed with foreign substances such as poison by using a syringe needle. The hole produced by the needle can be located to escape notice so that the tampering of the product remains undetected.

Although such malicious tampering could be overcome by enclosing the product in a hard casing, it has until now been uneconomical to do so as it would add significantly to the overall selling cost of the product. Also, such a hard casing could well be difficult to open by the final end user of the product.

It is therefore an object of the present invention to provide a tamper proof container for protecting any product stored within from the type of malicious tampering referred to above.

It is another object of the present invention to provide a tamper proof container that provides a visual indication of the container having been opened.

It is a further object of the present invention to provide a tamper proof container that is relatively economical to manufacture, and is also relatively easy to open by the end user.

With this in mind, according to one aspect of the present invention, there is provided a tamper proof container comprising:

a container body within which product can be accommodated, the container body comprising a base section, a lid section and tamper prevention means interconnecting the base and lid sections, the tamper prevention means comprising a web section located between and secured to both the base and lid sections wherein the web section is detachable from the container, the detaching of the web section allowing the separation of the base and lid sections of the container body, the removal of the web section further providing a visual indication that the container has been opened; and the lid section comprising an intermediate section and a cover adapted to be secured to the intermediate section to form the lid section, the cover adapted to be secured by cooperating coupling means to the intermediate section to prevent ready removal therefrom.

The base and lid sections when secured together via the web section together form the tamper proof container within which the product can be accommodated. The container can only be opened by detaching the web section from between the base and lid sections to thereby separate said sections of the container body. The tamper proof container according to the present invention provides no access for a hypodermic needle because of the presence of the web section interconnecting the base and lid sections of the container body.

The container body may be of any shape depending on the type of product to be accommodated. For example, the container body may be rectangular or square in shape when seen in plan view and may having a relatively narrow profile when seen from the side. Such a container body would be appropriate for flat products such as blister packed tablets or capsules or flat packed condoms. Other container shapes are envisaged to take into account the type of product being accommodated. For example, the container could also be round, or a pentagon or hexagon shape when seen in plan view.

A further visual indication means may be provided as part of the web section, and may for example include a product hanging hook or tag extending from the container and formed as part of the web section. It is however also envisaged that the product hanging hook or tag be separately secured to the web section. This visual indication means may also provide a means to detach the web section from the rest of the container body as it provides a pulling point for applying a pulling force on the web section. The web section can detach from the rest of the container body when a sufficient pulling force is applied. A lateral cut may be provided though the web section to provide an initial tear point for the web section. This tear point may be located adjacent the area where the pulling force can be applied to the web section. The removal of this visual indication means also provides a clear visual indication that the container has been opened.

The cover may include a peripheral wall extending along the periphery of the cover, and the coupling means may include non releasable snap clip arrangement which may include a plurality of tungs extending from the peripheral wall thereof. Each tung may include an undercut shoulder for engaging a cooperating shoulder provided on an inner surface of the intermediate section. The coupling means may further include an inwardly facing shoulder provided along the edge of the peripheral wall of the cover between each tung for engaging a cooperating outwardly engaging shoulder provided along the peripheral edge of the intermediate section abutting the cover. The cover can therefore be snapped into position over the intermediate section, the coupling means acting on opposite sides of the wall of the intermediate section to thereby subsequently prevent separation of the cover from the intermediate section. The cover cannot then be readily released from the intermediate section after engagement thereof. Furthermore, the engagement of the coupling means and the peripheral edges of the cover and intermediate section prevents ready access of a hypodermic needle at the junction therebetween. Other means for coupling the cover to the intermediate section are however also envisaged. The provision of the cover allows product to be placed into the container prior to the securing of the cover to the rest of the container. The container can then only be opened by the removal of the tamper prevention means once the cover has been secured to the container.

The tamper proof container may further include cooperating engagement means on the base and lid sections respectively. The engagement means may for example be cooperating hinge members. A pair of lateral extensions through which are provided pivot openings may be provided on one of the base or lid sections, with a pair of lateral extensions supporting pivot stub axles may be supported on the other said section. The base and lid sections when separated can then be subsequently hinged together by engaging the stub axles on one section to the pivot openings on the other section thereof to provide a hinged lid container.

According to another aspect of the present invention, there is provided a method of producing a tamper proof container having a container body with a base section, a lid section including an intermediate section and a cover secured to the intermediate section, and tamper prevention means including a web section located between and secured to both the base and lid sections, the web section being separable from the container, the method including separately molding the base section and the intermediate section, supporting the base and intermediate sections within an injection molding die, injection molding a web section between the base and intermediate sections so that the web section is secured to both said sections.

The cover can be produced separately and can be coupled to the intermediate section to complete the assembly of the container.

The web section may therefore be formed of a material which is different to the material forming the base and intermediate portions of the container body. The web section may for example be made of an elastomeric material such as "santoprene" (Registered Trademark of Advanced Elastomer Systems L.P.). The base and lid sections can then be made of a more rigid material such as ABS plastic or a related thermoplastic material. Again, the use of other materials is also envisaged.

According to a further aspect of the present invention, there is provided a method of producing a tamper proof container having a container body with a base section, a lid section including an intermediate section and a cover secured to the intermediate section, and a tamper prevention means including a web section located between and secured to both the base and lid sections, the web section being separable from the container, the method including molding the base section, web section and intermediate section as an integral unit.

The cover may be formed separately and subsequently secured to the intermediate section to form the complete container.

The web section may be formed as an integral unit with the base and intermediate sections, the lid being subsequently secured to the intermediate section. The web section may therefore be formed with thin wall sections provided between the web section and the base and intermediate sections respectively of the container body. The thin wall sections may provide a frangible connection for the web section to both the base and intermediate sections of the container body. To this end, this integral unit can be made of a material that can allow the separation of the web section from the rest of the integral unit. The integral unit may for example be made of a relatively soft and resilient plastic such as polyethylene and polypropylene. The use of other materials is however also envisaged.

The tamper proof container according to the present invention is resistant to tampering by the use of hypodermic syringes and cannot be opened without providing a clear visual indication that the container has been opened. The container can however continue to be used as a storage container after opening where engagement means such as hinge members are provided on the base and cover sections.

It will be convenient to further describe the invention with respect to the accompanying drawings which illustrate a preferred embodiments of the tamper proof container according to the present invention. Other embodiments of the invention are possible, and consequently, the particularity of the accompanying drawings is not to be understood as superceding the generality of the preceding description of the invention.

Figure 3A:
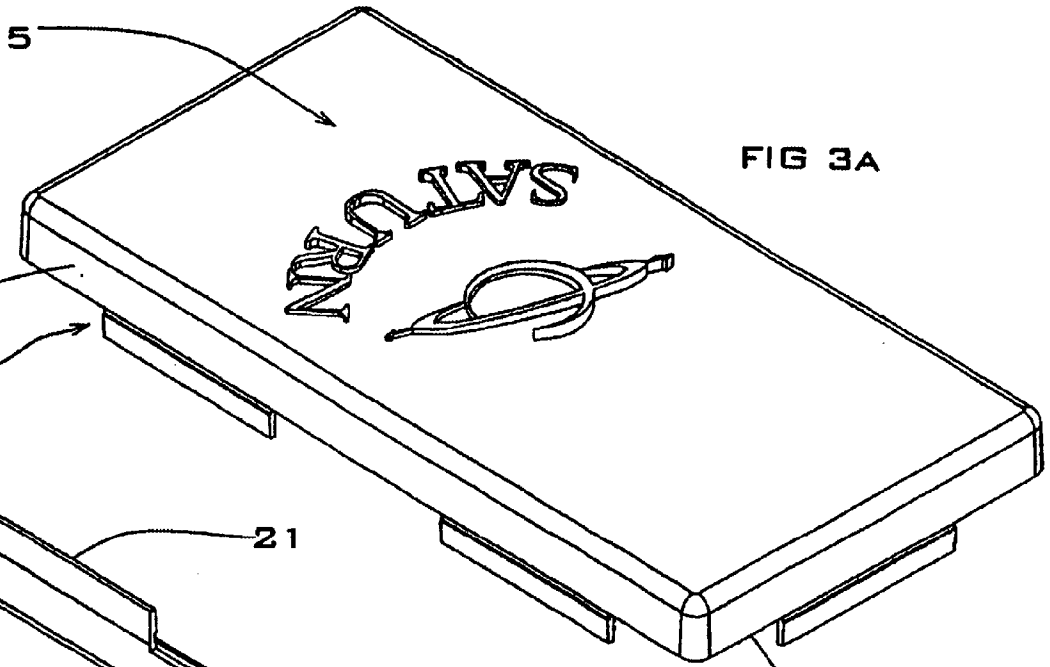
Figure 3B:
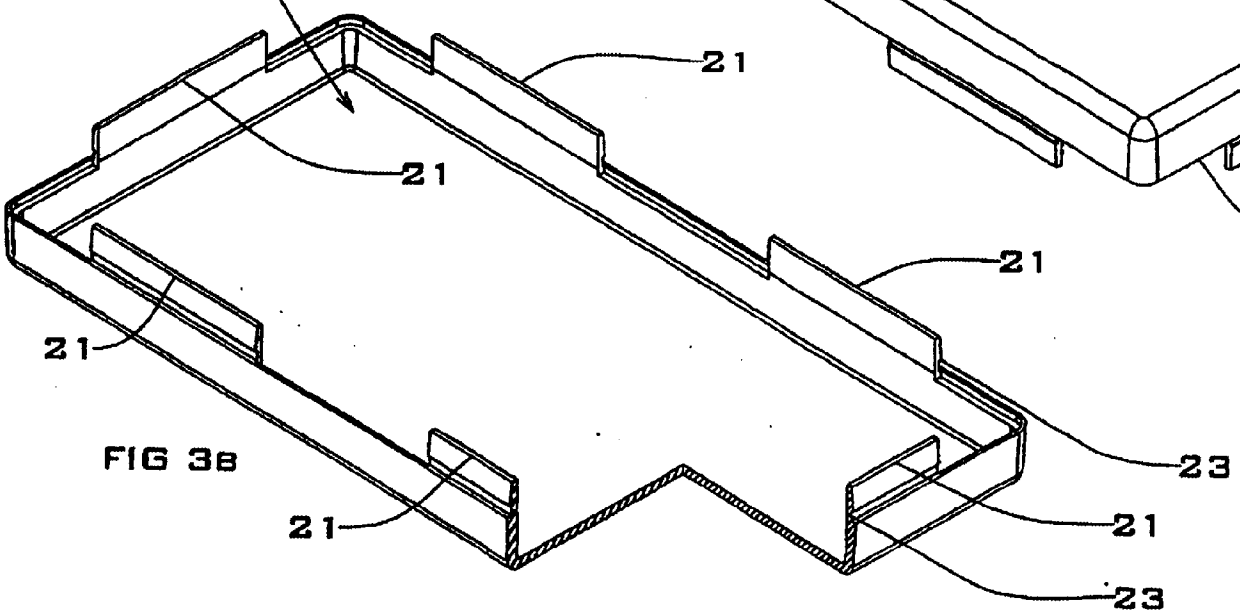
Figure 4:
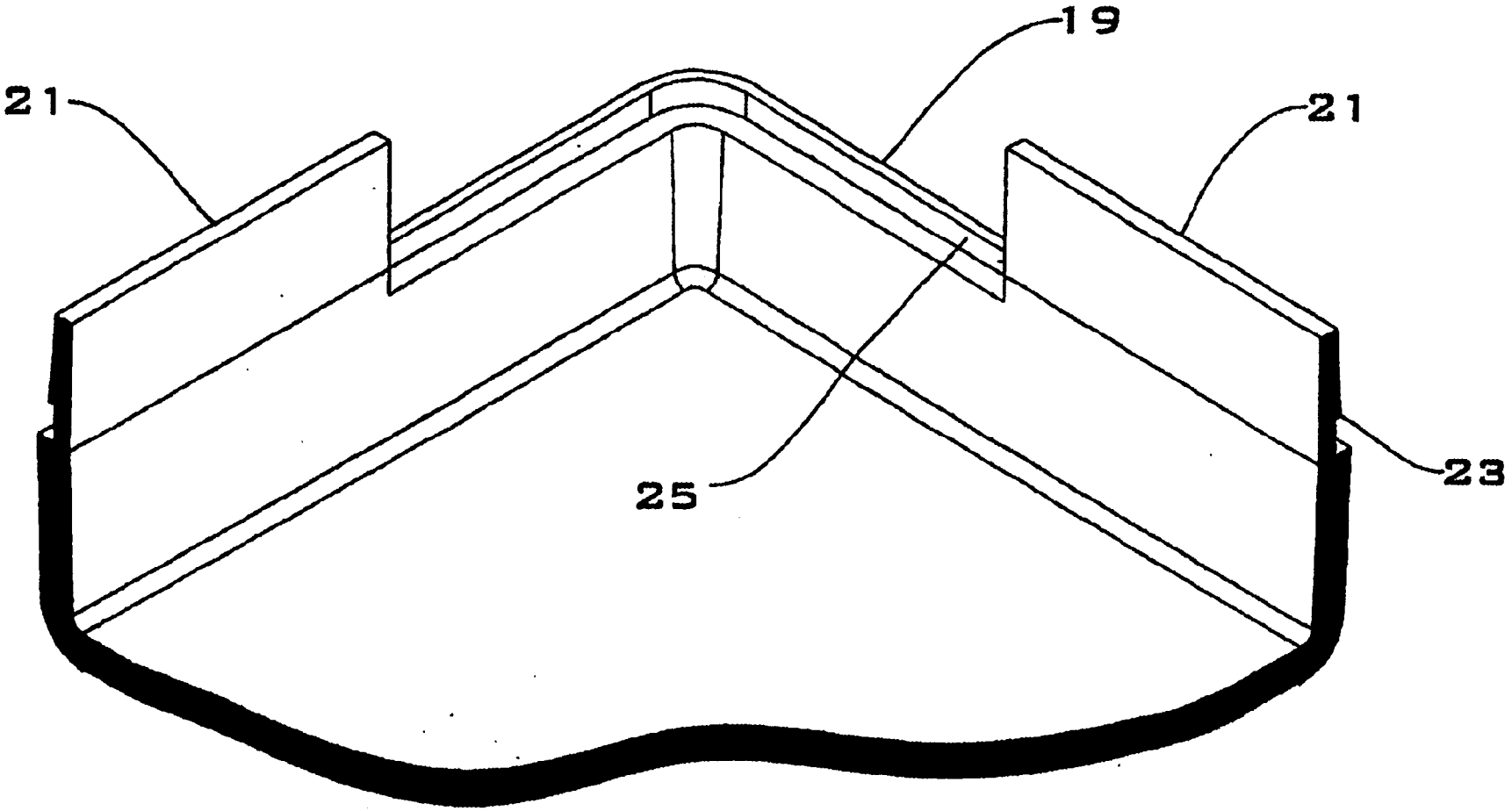

FIGS. 3*a* and 3*b* are top and bottom views respectively of the cover of the container according to the present invention;

FIG. 4 is a detailed view of a corner of the cover as shown in FIGS. 3*a* and 3*b;*

Figure 1:
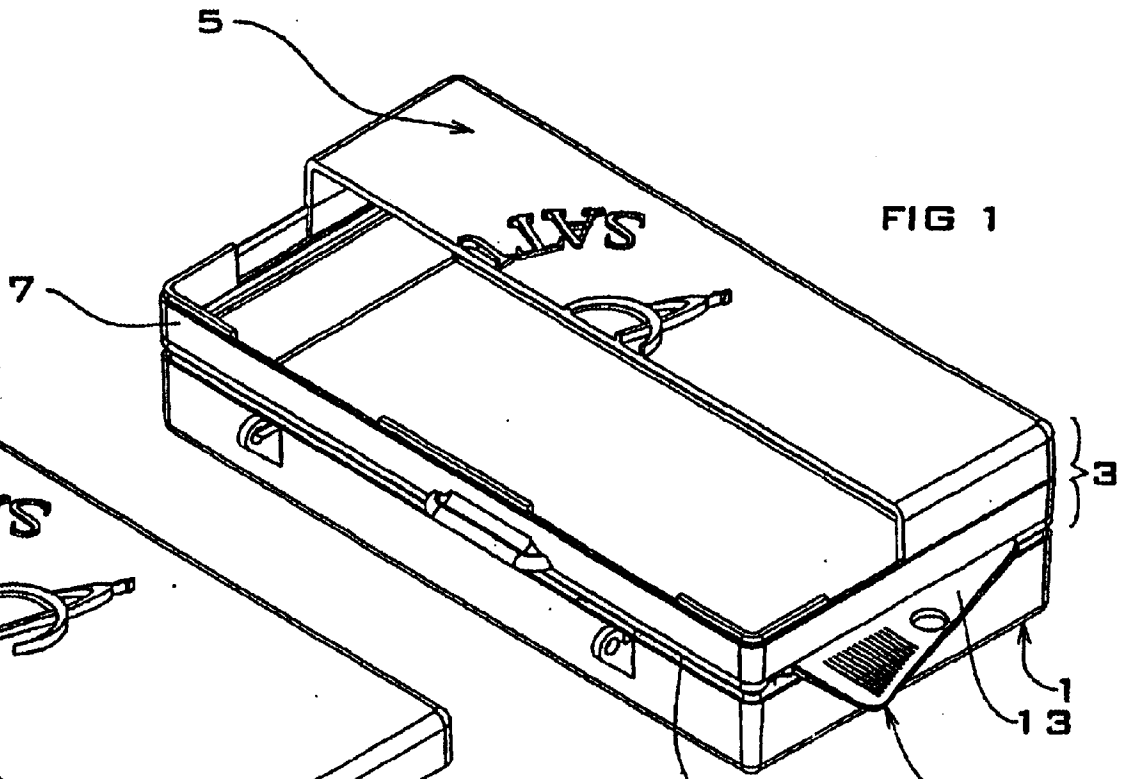
FIG. 1 is an isometric view of an assembled tamper proof container according to the present invention showing one half of a cover of the container.
Figures 5A, 5B:
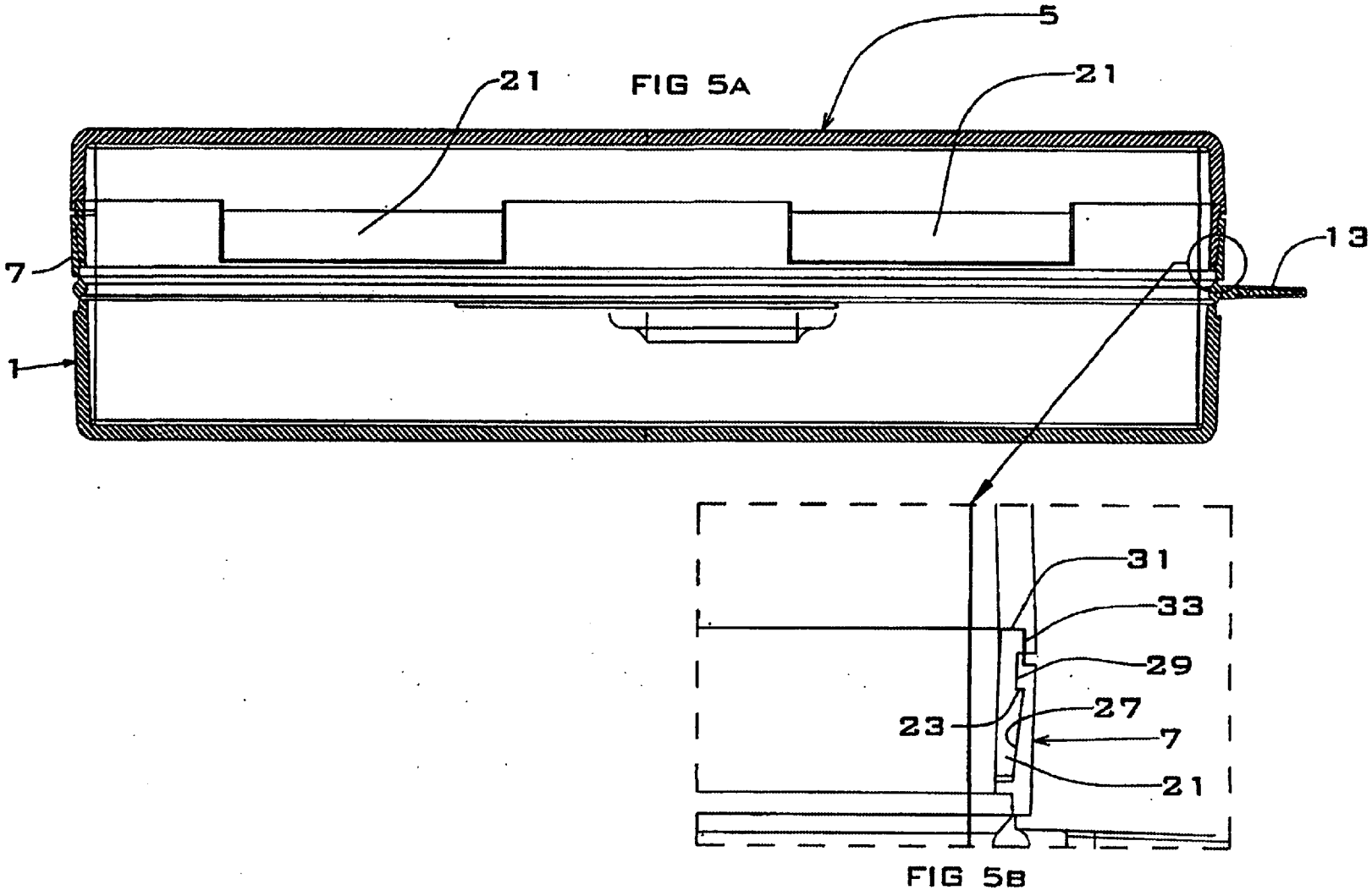
Figures 6, 7:
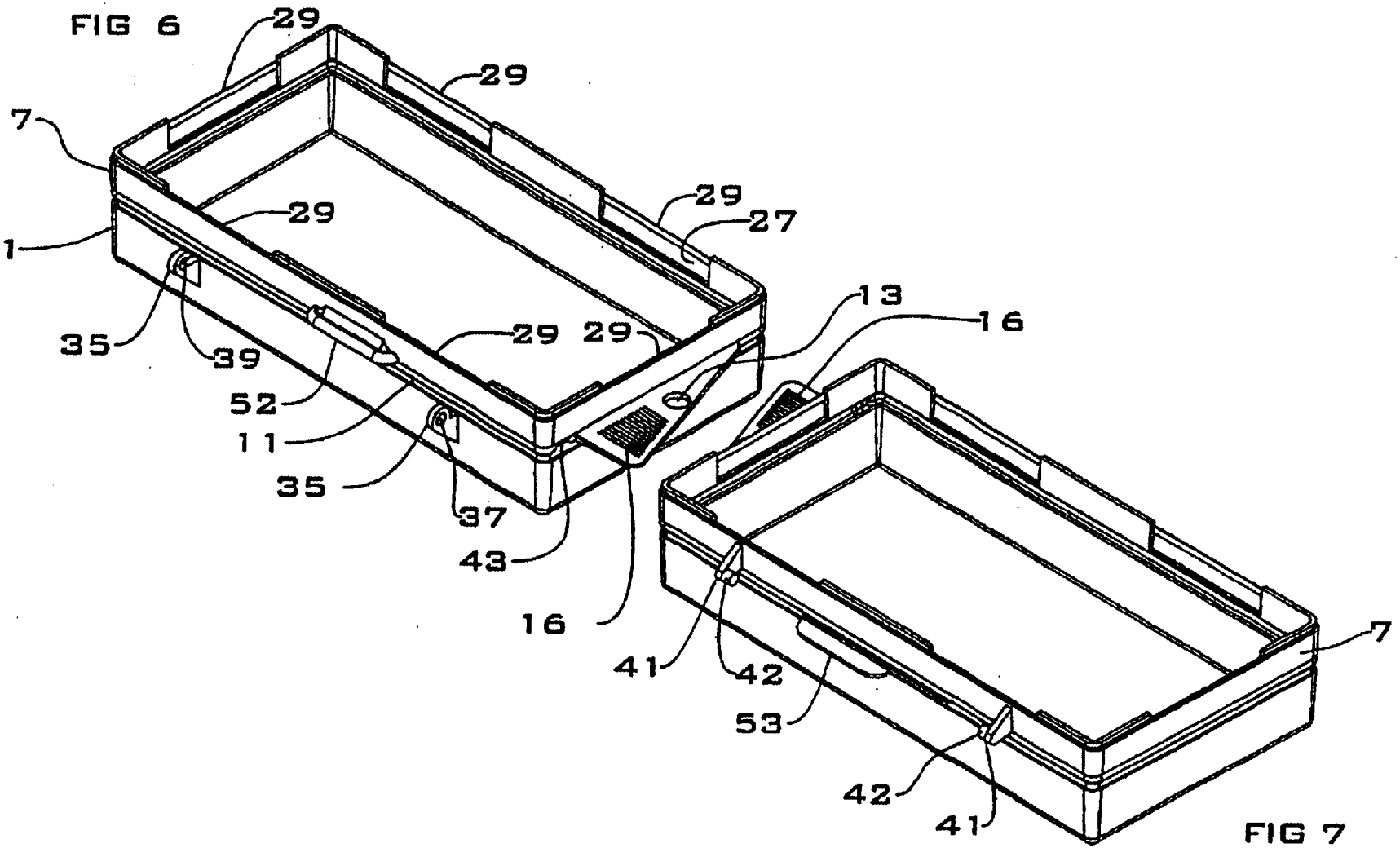
Figure 8:
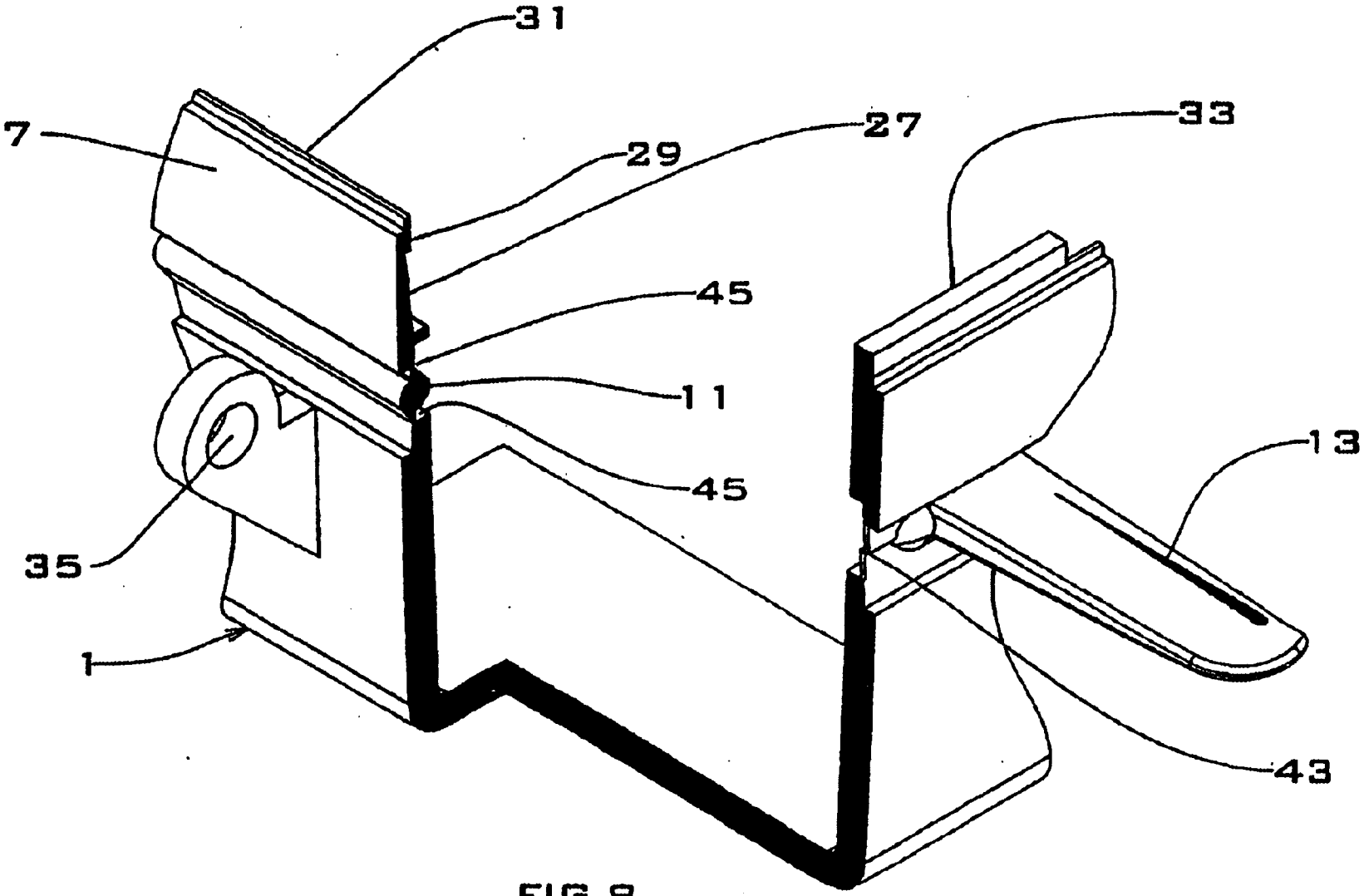
Figures 9A, 9B:
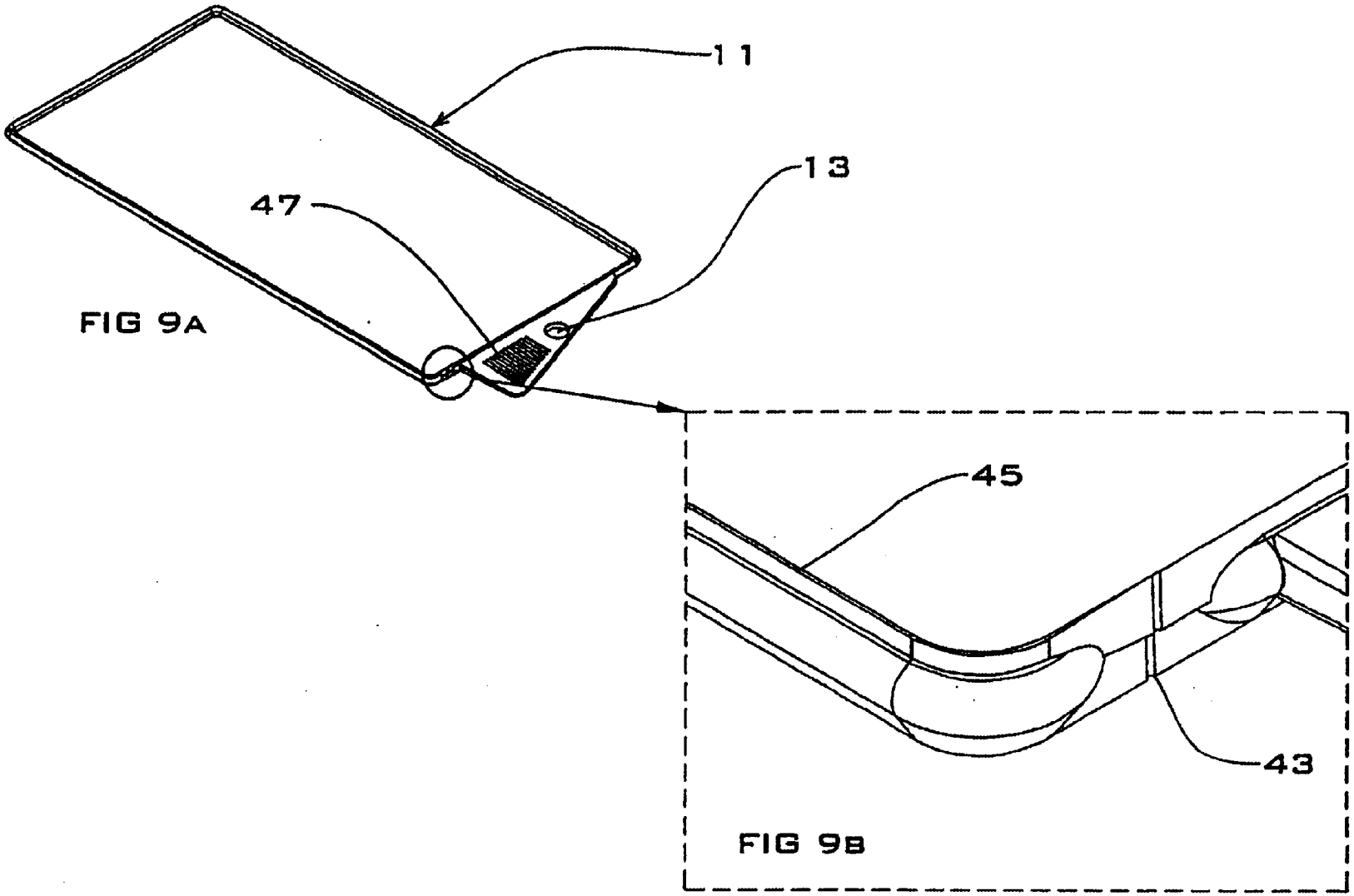
Figures 10A, 10B:
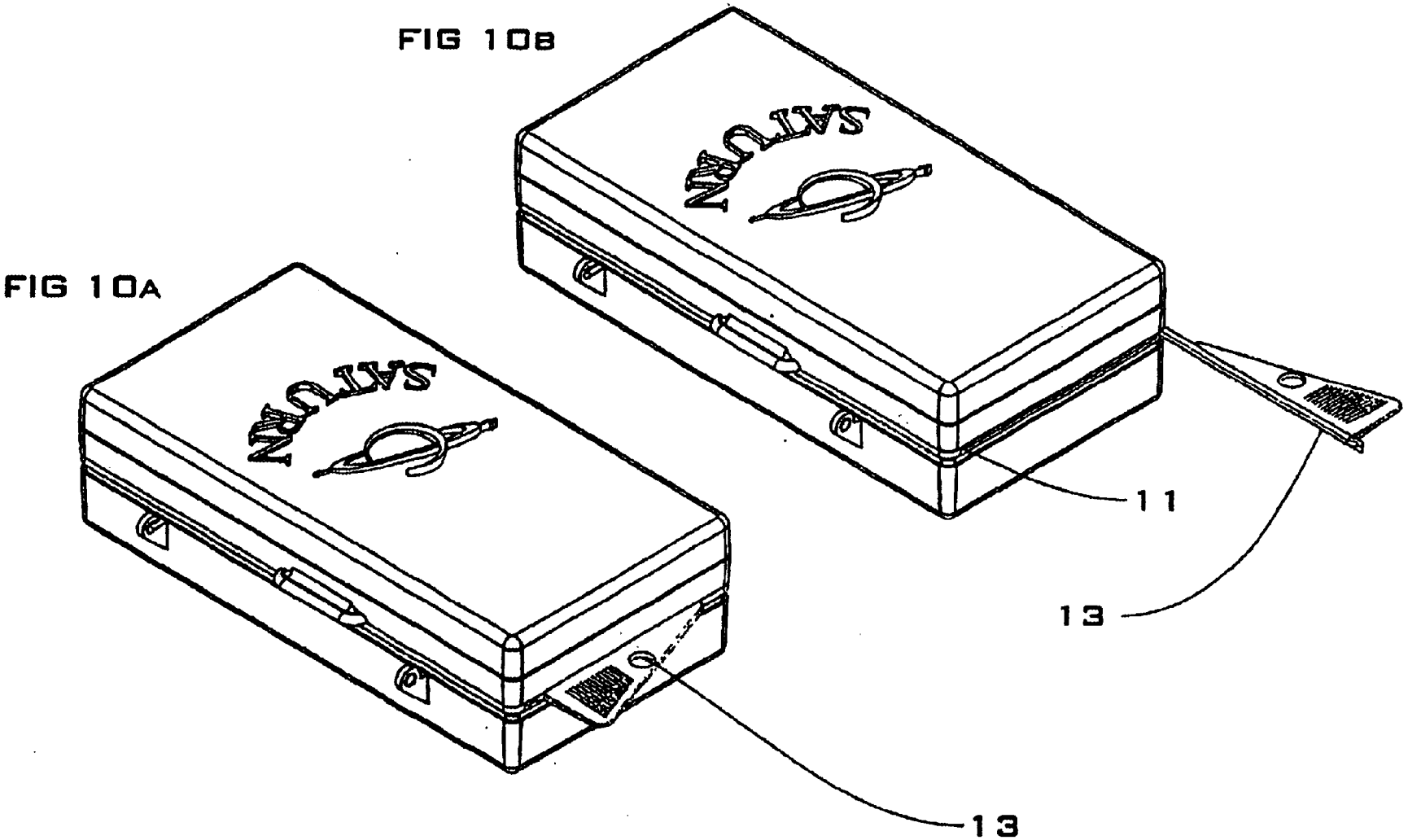
Figures 10C, 10D:
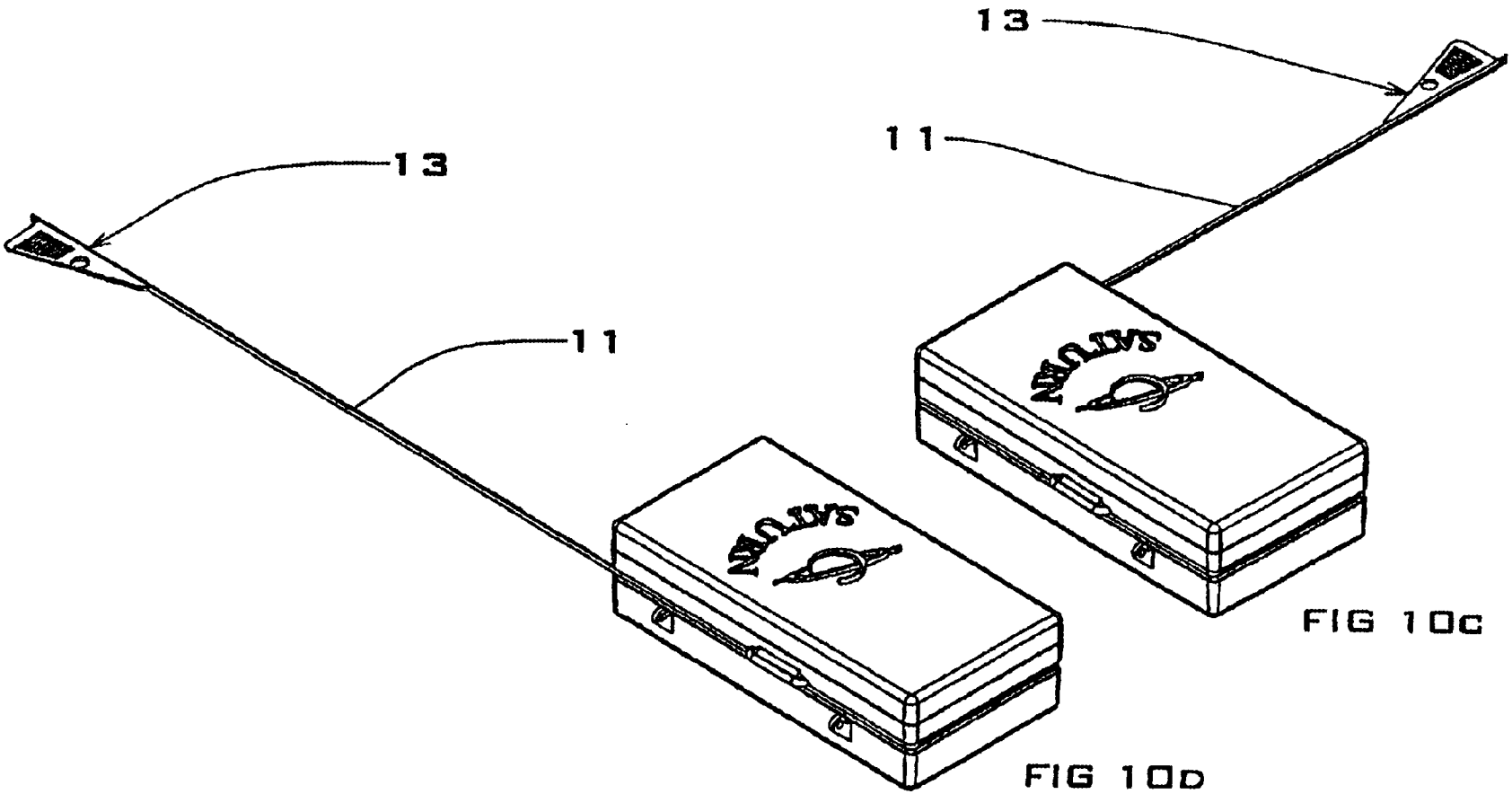
Figure 11A:
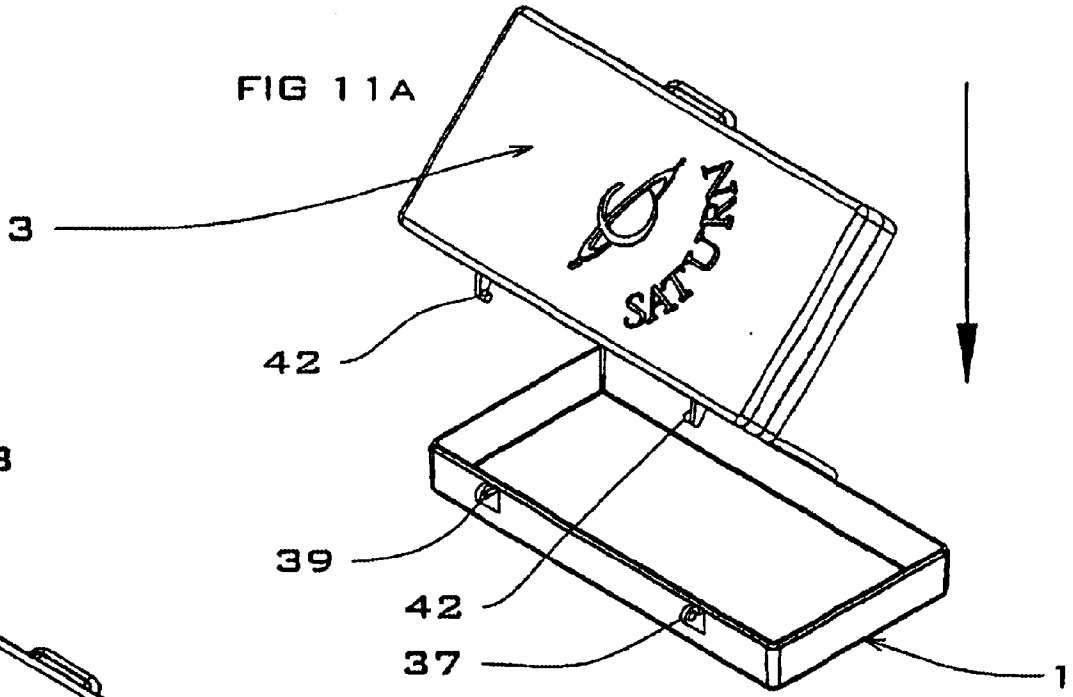
Figure 11B:
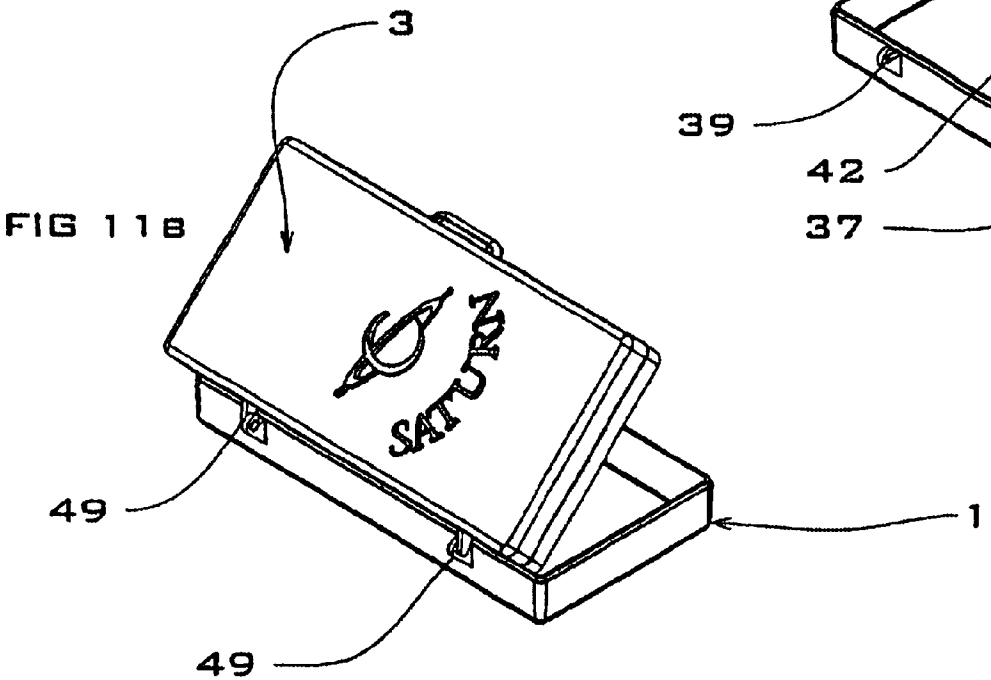
Figure 11C:
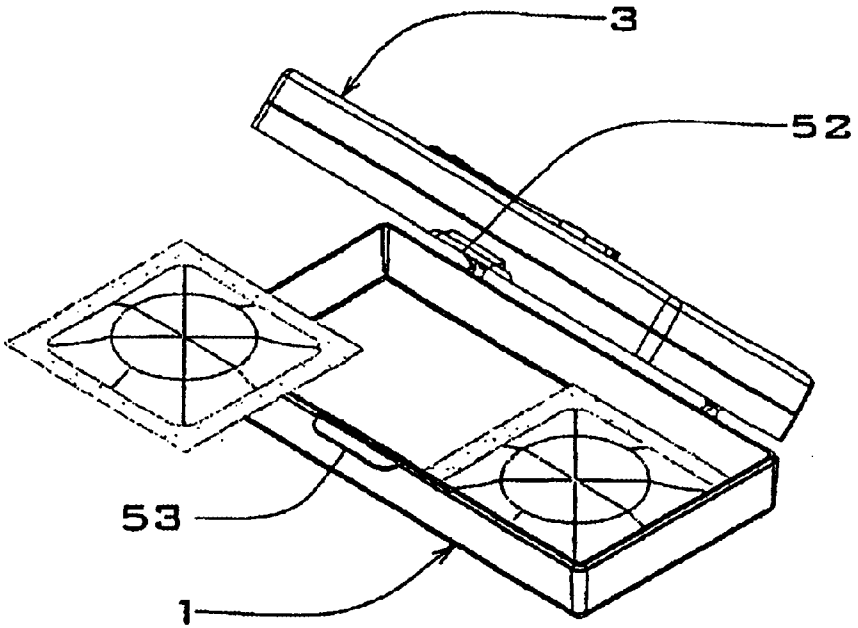
Figure 11D:
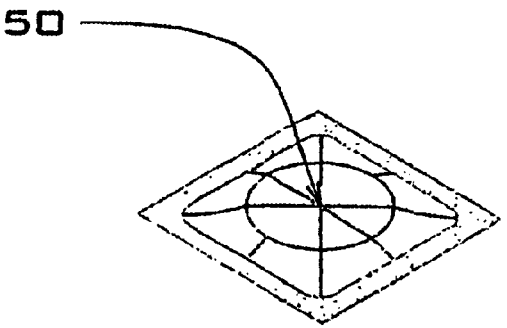
Figure 11D:
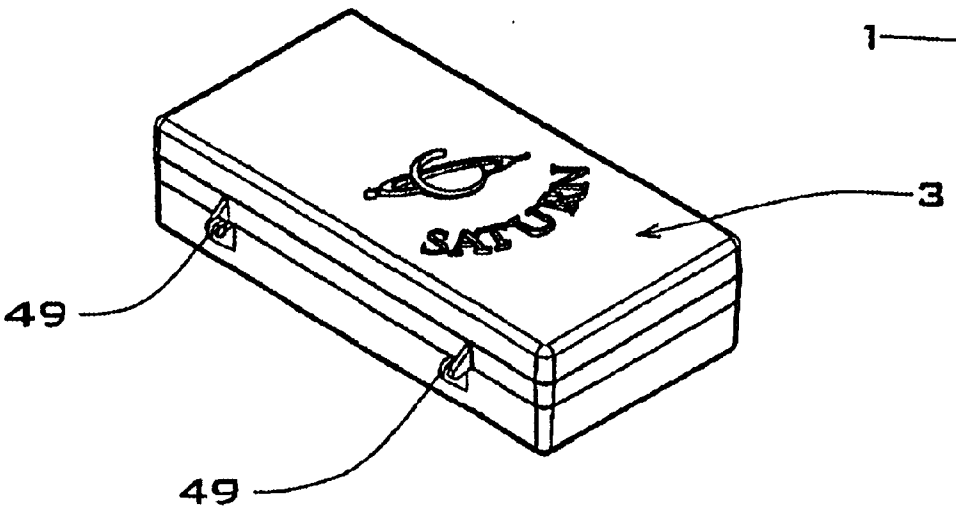
Figure 12:
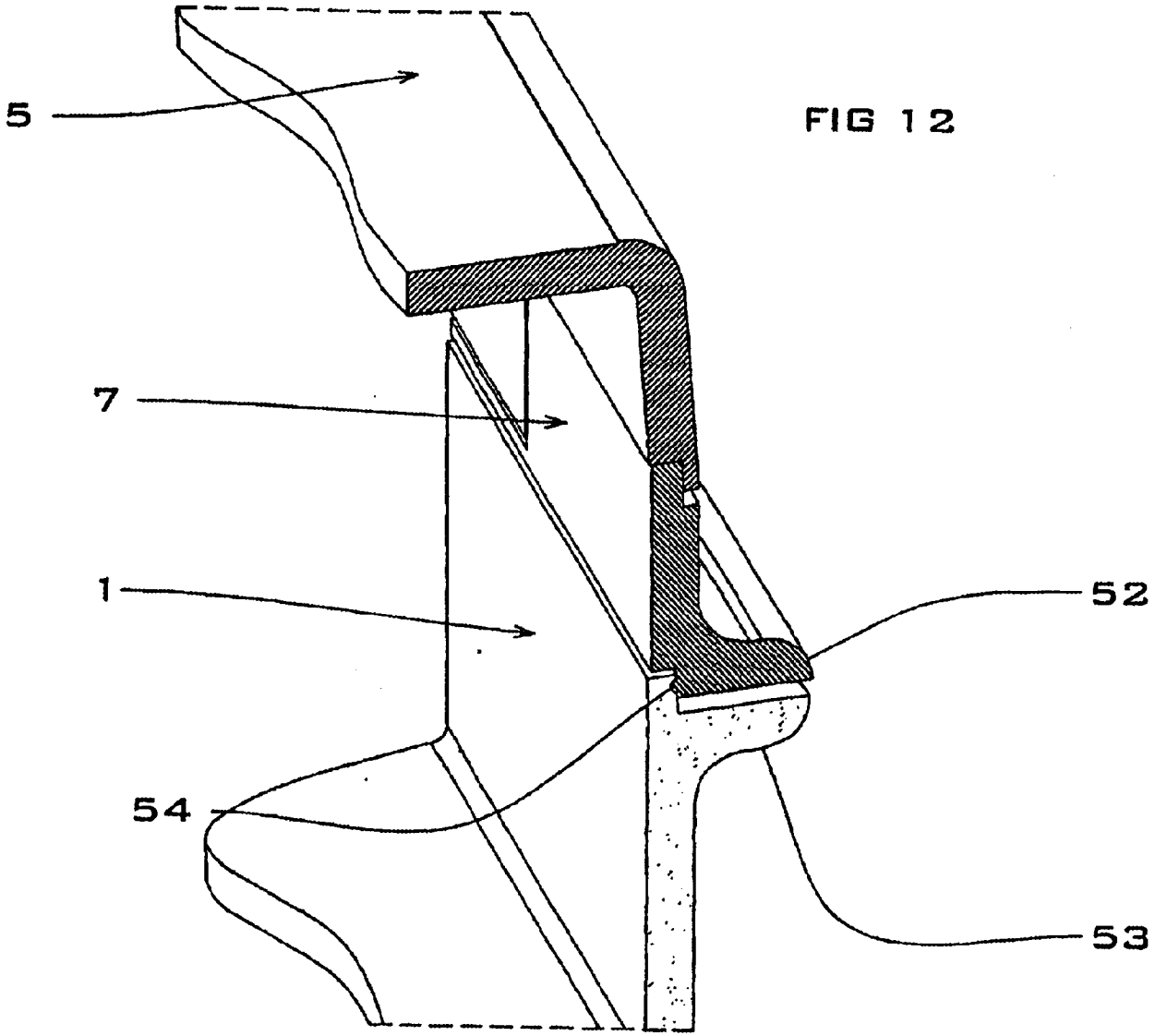

FIG. 5*a* is a cross sectional view of the container of FIG. 1;

FIG. 5*b* is a detailed cross sectional view of the engagement area of the cover to the rest of the container;

FIGS. 6 and 7 are respective isometric views of opposing sides of the container according to the present invention with the cover removed;

FIG. 8 is a detailed cross sectional view of a corner of the container with the cover removed as shown in FIG. 6;

FIGS. 9*a* and 9*b* are respective isometric and detailed views of the web section of the container according to the present invention;

FIGS. 10*a* to 10*d* show the sequence of detachment of the web section of the container according to the present invention;

FIGS. 11*a* to 11*d* show the sequence of the assembly of the container according to the present invention into a hinged lid container following removal of the web section; and FIG. 12 is a detailed cross sectional view of the assembled container of FIG. 11*a* to 11*d*.

Figure 2:
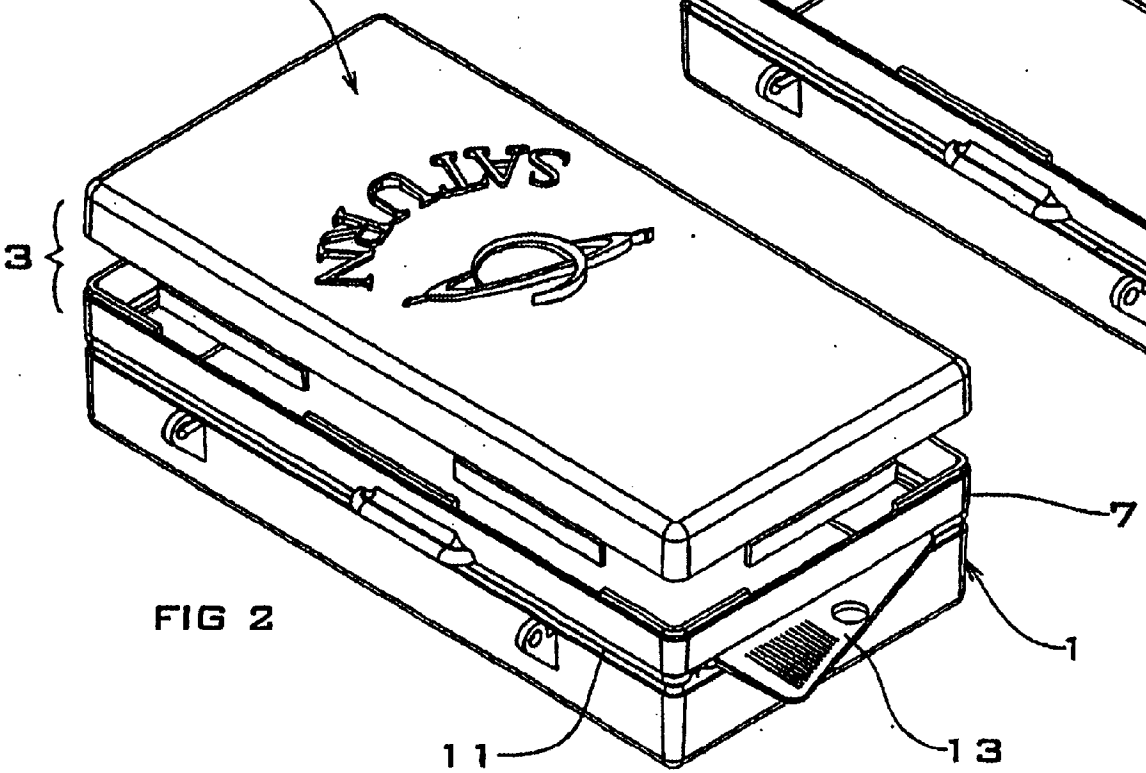
FIG. 2 is an exploded view of the container of FIG. 1 showing the complete cover separated from the rest of the container.

Referring initially to FIGS. 1 and 2, the tamper proof container according to the present invention includes a base section 1 and a lid section 3, the lid section 3 including a cover 5 and an intermediate section 7. The both section 1 and intermediate section 7 are interconnected by a tamper prevention means 9. This tamper prevention means 9 includes a web section 11 located between and secured to both the base section 1 and the lid section 3. The container further includes a product hanging tag 13 which is formed as part of the web section 11. The operation of the tamper prevention means 9 will be subsequently described.

FIGS. 3*a* and 3*b* show in more detail the cover 5. This cover 5 includes a peripheral wall 15 along its periphery. Coupling means 17 are provided along the peripheral edge 19 of the peripheral wall 15. The coupling means 17 include a plurality of tungs 21 extending from the peripheral edge 19 thereof.

FIG. 4 shows in more detail the configuration of the tungs 21 and the peripheral edge 19. Each tung 21 includes an undercut shoulder 23. Furthermore, the peripheral edge 19 between each tung 21 includes an inwardly facing shoulder 25.

FIGS. 5*a* and 5*b* show in more detail the cooperation of the cover 5 to the intermediate section 7. When the cover 5 is secured to the intermediate section 7, each tung 21 is supported within a cooperating shallow depression 27 provided within an internal face of the intermediate section 7. The undercut shoulder 23 of each tung 21 engages a cooperating shoulder 29 provided within the shallow depression 27 of the intermediate section 7. This provides a "snap" fitting of the cover 5 to the intermediate section 7.

The inward facing shoulder 25 provided on the peripheral edge 19 of the cover 7 cooperates with an outwardly engaging shoulder 33 provided along the peripheral edge 31 of the intermediate section 7. The tung 21 and inwardly facing shoulder 27 act on opposing sides of the wall of the intermediate section 7. This thereby prevents ready removal of the cover 5 from the intermediate section 7 when located thereon. This cooperation of the cover peripheral edge 19 and the intermediate section peripheral edge 31 also provides a barrier to the insertion of a hypodermic needle through the junction between the cover 5 and intermediate section 7.

FIGS. 6 and 7 show in more detail the container with the cover 5 removed. On one side of the base section 1 is provided a pair of lateral extensions 35 extending therefrom. Each lateral section 35 includes pivot openings 37, 39. A finger engaging tag 52 is provided on the intermediate section 7. The other side of the container includes a pair of lateral extensions 39 extending from the intermediate section 7. These lateral sections 41 respectively support a stub axle 42. These stub axles 42 are adapted to engage the pivot openings 37, 39 following the removal of the web section 11 from the container as will be subsequently described.

Another finger engaging tag 53 is provided on the base section 1.

The web section 11 includes a cut adjacent the product hanging tag 13. This opening 43 provides an initial tear point for the web section 11. The product hanging tag 13 also provides a finger grip 16 to enable a pulling force to be applied to the web section 11.

FIG. 8 shows in more detail the web section 11. This web section 11 is connected via a frangible connection 45 to the base section 1 and intermediate section 7 respectively. This enables the web section 11 to be separated from the base section 1 and intermediate section 7.

The web section 11 may be formed integrally with the base section 1 and intermediate section 7. This part of the container can be injection moulded using plastic such as polyethylene or polypropylene. This plastic has a relatively low density and is relatively flexible. To this end, this will enable a frangible connection 45 to be formed for the web section 11.

It is also possible to produce the intermediate section 7 and base section separately from the web section 11. To this end, the base section 1, intermediate section 7 and cover 5 can be initially formed in a preliminary injection procedure. These sections can be formed of a relatively rigid plastic such as ABS or related thermoplastic material. These plastics are relatively dense and it is therefore difficult for a hypodermic needle to penetrate such plastic. The intermediate section 7 and base section 1 can then be subsequently located within an injection die, and the web section 11 is then injection moulded in a separate operation to thereby secure both the base and lid sections 1, 7 together. The web section 11 can be made of a relatively resilient plastic such as "santoprene" which can adhere to both the base and intermediate sections 1, 7, once it has been injection moulded therebetween.

FIGS. 9*a* and 9*b* show the final configuration of the web section 11 having a frangible connection 45 and an initial tear point 43 located adjacent to a finger grip area 47 provided on the product hanging hook 13.

FIGS. 10*a* to 10*d* show the sequence of operation of the removal of the web section 11 from tamper proof container of the present invention. Shown is the progressive separation of the web section 11 around the container. This container can not be opened until the web section 11 is entirely removed. The removal of the web section 11 provides an indication that the container has been opened and/or been tampered with. The web section 11 is removed by applying a pulling force on the product hanging tag 13 until the web section 11 is entirely separated from the rest of the container. The removal of the product hanging hook 13 also provides a visual indication of the opening of the container.

FIGS. 11 *a* to 11*d* show the assembly of the base section 1 and lid section 3 of the container to provide a hinged lid container for storing product 50 located therein once the web section 11 has been removed. The stub axles 42 located on the lid section 3 are located into the pivot openings 37, 39 provided on the base section 1 to provide a hinge connection 49 for the lid section 3 and base section of the container. This container can then be used to store the product 50 therein.

The finger engaging tags 52, 53 of the base section 1 and lid section 3 are aligned in an adjacent relation when the hinged lid container is fully assembled as shown in FIG. 12. An indent engagement arrangement 54 is provided between the base section 1 and the intermediate section 7 to releasably hold the lid section 3 over the base section 1. The finger engaging tags 52, 53 provide the means by which the container can be opened.

The tamper proof container according to the present invention provides a clear indication that the container has been opened and/or tampered with. The construction prevents the type of malicious tampering previously referred to.

Modifications and variations as would be deemed obvious to the person skilled in the art are included within the ambit of the present invention as defined in the appended claims.

Throughout the specification, unless the context requires otherwise, the words "comprise" or variations such as "comprises" or "comprising" and "include" or variations such as "includes" or "including", should be understood to imply the inclusion of a stated integer or group of integers but not the exclusion of any other integer or group of integers.

What is claimed is:

1. A tamper proof container comprising a container body within which product can be accommodated, the container body comprising a base section, a lid section and tamper prevention means interconnecting the base and lid sections; the tamper prevention means comprising a web section located between and secured to both the base and the lid sections wherein the web section is detachable from the container, the detaching of the web section allowing the separation of the base and lid sections of the container body, the removal of the web section further providing a visual indication that the container has been opened; and the lid section comprising an intermediate section and a cover adapted to be secured to the intermediate section to form the lid section, the cover adapted to be secured by cooperating coupling means to the intermediate section to prevent ready removal therefrom.

2. A tamper proof container according to claim 1, further comprising a further indication means provided as part of the web section, the further indication means including a tag extending from the container and formed as part of the web section, the web section being detached from the rest of the container by applying a pulling force on the tag.

3. A tamper proof container according to claim 1 wherein the cover includes a peripheral wall extending along the periphery of the cover, and the coupling means includes non releasable snap clip arrangement which include a plurality of tungs extending from the peripheral wall thereof, each tung including an undercut shoulder for engaging a cooperating shoulder provided on an inner surface of the intermediate section, the coupling means further including an inwardly facing shoulder provided along the edge of the peripheral wall of the cover between each tung for engaging a cooperating outwardly engaging shoulder provided along the peripheral edge of the intermediate section abutting the cover.

4. A tamper proof container according to claim 1 further including cooperating engagement means on the base and lid sections respectively.

5. A tamper proof container according to claim 4, wherein the engagement means are cooperating hinge members including a pair of lateral extensions through which are provided pivot openings provided on one of the base or lid sections, with a pair of lateral extensions supporting pivot stub axles being supported on the other said section.

6. A tamper proof container according to claim 1 wherein the web section is formed of an elastomeric material, the lid and base sections being formed from a relatively rigid material.

7. A tamper proof container according to claim 6, wherein the elastomeric material is Santoprene.

8. A tamper proof container according to claim 6, wherein the lid and base sections are formed from ABS plastic.

* * * * *